US006239551B1

(12) United States Patent
Park

(10) Patent No.: US 6,239,551 B1
(45) Date of Patent: May 29, 2001

(54) DISCHARGE SPACE STRUCTURE OF PLASMA DISPLAY PANEL AND METHOD OF FABRICATING ITS BARRIER

(75) Inventor: Myung-Ho Park, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/090,406

(22) Filed: Jun. 4, 1998

(30) Foreign Application Priority Data

Jun. 5, 1997 (KR) ..... 97-23358
Jun. 5, 1997 (KR) ..... 97-23359

(51) Int. Cl.[7] ..... H01J 1/88
(52) U.S. Cl. ..... 313/582; 313/292
(58) Field of Search ..... 313/582, 292

(56) References Cited

U.S. PATENT DOCUMENTS 5,032,768 * 7/1991 Lee et al. ..... 313/582
5,682,081 * 10/1997 Reynolds ..... 313/584
5,723,945 * 3/1998 Schermerhorn ..... 313/581
5,770,921 * 6/1998 Aoki et al. ..... 313/582

* cited by examiner

*Primary Examiner*—Vip Patel
(74) *Attorney, Agent, or Firm*—Finnegan, Henderson, Farabow, Garrett & Dunner, L.L.P.

(57) ABSTRACT

A discharge space structure of a plasma display panel is provided in which rays generated by a cell are not diffused into neighboring cells but sent to the front of the panel, to prevent color spread in the same stripe, improving luminance of the plasma display panel. The plasma display panel is constructed in such a manner that the front and back substrates, parallel to each other, are combined using frit glass, a dielectric layer is formed on display electrodes arranged on the front substrate, a protective layer formed on the dielectric layer, address electrodes are arranged on the back substrate, barriers are formed between the address electrodes, and a fluorescent layer is formed between the barriers, in which each discharge space defined by the fluorescent layer is formed in a hemispheric shape, to send rays generated by the fluorescent layer to the front of the panel.

14 Claims, 7 Drawing Sheets

COATING PHOTORESIST

EXPOSING / DEVELOPING

ETCHING SOLUTION

DISCHARGE SPACE STRUCTURE OF PLASMA DISPLAY PANEL AND METHOD OF FABRICATING ITS BARRIER

BACKGROUND OF THE INVENTION

1. Field of the Invention

The present invention relates to a plasma display panel (referred to hereinafter as PDP) and, more particularly, to a discharge space structure of a PDP and method of fabricating its barrier, in which the center of each discharge space formed by barriers has a height different from that of the boundary between discharge spaces adjacent to each other, to prevent undesirable discharge from occurring in neighboring cells when address discharge between a sustain electrode and address electrode is carried out.

2. Discussion of Related Art

FIG. 1 shows a structure of a conventional three-electrode plane discharge PDP. Referring to FIG. 1, the PDP is composed of the front substrate 1 for displaying pictures and back substrate 2 arranged in parallel with the front substrate 1, having a specific distance from each other. The front substrate 1 has a plurality of sustain electrode lines 6 in a certain interval, a dielectric layer 8 formed on a plurality of sustain electrode lines 6 to restrict discharge current, and a protective layer 9 formed on dielectric layer 8 to protect sustain electrode lines 6. The back substrate 2 has a plurality of barriers 3 for forming a plurality of discharge spaces, a plurality of address electrode lines 4 formed between barriers 3, perpendicular to sustain electrode lines 6, and a fluorescent layer 5 formed on both sides of barriers 3 so as to cover address electrode lines 4, to emit a visible ray during discharge.

FIG. 2 is a cross-sectional view showing the combination of the front and back substrates of FIG. 1. A process of displaying a picture using cells in the conventional PDP constructed as above is explained below. First of all, when a preliminary discharge voltage is applied to corresponding sustain electrode lines 6, preliminary discharge occurs between sustain electrode lines 6 to allow the following address discharge to occur stably. When an address discharge voltage is supplied to the sustain electrode line 6 and corresponding address electrode line 4, address discharge is carried out between them. That is, an electric field is created inside the cell to accelerate electrons in a discharge gas, and neutral particles in the gas collide with the accelerated electrons to be ionized into electrons and ions. The neutral particles' collision with the ionized electrons is repeated so that the neutral particles are ionized into electrons and ions rapidly. By doing so, the discharge gas is transformed into a plasma state, and simultaneously vacuum ultraviolet rays are generated.

The vacuum ultraviolet rays excite fluorescent layer 5, to generate a visible ray. When this visible ray is externally emitted through front substrate 1, radiation of a cell, and thereby display of a picture, can be externally recognized. Thereafter, when a sustain discharge voltage of above 150V is supplied to corresponding sustain electrode lines 6, sustain discharge occurs between them, maintaining radiation of each cell for a certain period of time.

A process of forming discharge space in the conventional PDP is described below with reference to FIGS. 2 and 3. First of all, address electrodes 4 are formed on back substrate 2, and barriers 3 for preventing undesirable discharge from generating in neighboring discharge regions are formed between address electrodes 4. Front and back substrates 1 and 2 are combined using frit glass (not shown). A discharge gas is put into the discharge space formed inside the combined substrates, and then the combined substrates are sealed. Barrier 3 is conventionally formed in such a manner that a dielectric layer is formed and multi level printed in a certain pattern using a screen mask. The height of barrier 3 is conventionally approximately 100 to 150 $\mu$m. To obtain this height, it is required that the dielectric layer is sequentially laminated ten times and printed, and the minimum width of such a barrier is about 50 to 60 $\mu$m.

There is another method of forming the barrier, in which a barrier material is coated on the entire surface of the substrate, a mask layer is formed, and the barrier material layer is etched to form the barrier. The etching may be carried out through wet etching method using an etchant and dry etching method using an abrasive. A method of forming the barrier through the dry etching which is also called sand blast is explained below with reference to FIG. 4. Address electrodes 4 are formed on back substrate 2, a barrier material 10 is coated on the substrate including address electrodes 4 by 50 to 80 $\mu$m and dried, and a dry film 11 is laminated thereon. Dry film 11 is exposed by ultraviolet rays, covered with a mask, and developed to form a pattern. Then, barrier material layer 10 is etched by sand blast using the pattern as a mask, to form a barrier shape 10. The etching is carried out in such a manner that the barrier material layer is etched in an exfoliating solution for 100 to 300 sec, cleaned, and fired in a furnace at 200 to 500° C. for 20 to 60 min, thereby forming barriers 10. After the formation of barriers 10, dry film 11 is removed and the fluorescent layer is printed between the barriers.

In the conventional discharge space structure fabricated through the above-described process, all the centers of the discharge spaces and the boundary between neighboring discharge spaces have approximately the same height, as shown in FIG. 3. That is, the barriers and address electrodes are formed in parallel with each other. Accordingly, plasma can be easily diffused between cells which vertically lie adjacent to each other, and thus visible rays generated by the fluorescent layer intrude into each other in the same stripe during ultraviolet rays discharge, creating color spread. This deteriorates color purity.

SUMMARY OF THE INVENTION

Accordingly, the present invention is directed to a discharge space structure of a PDP and method of fabricating its barrier that substantially obviates one or more of the problems due to limitations and disadvantages of the related art.

An object of the present invention is to provide a discharge space structure of a PDP and method of fabricating its barrier, in which the center region of each discharge space formed by barriers has the height different from that of the boundary region between discharge spaces adjacent to each other, so as to prevent undesirable discharge from occurring in neighboring cells, to remove color spread in the same stripe during address discharge between a sustain electrode and an address electrode, and to effectively use a generated visible ray.

To accomplish the object of the present invention, there is provided a discharge space structure of a plasma display panel including first and second substrates opposite each other, a barrier layer formed on the first substrate and having a plurality of raised portions, and a plurality of discharge spaces, each space being formed between the barrier layer and the second substrate, and being at least partially defined by at least two adjacent raised portions of the barrier layer.

A method of making the barrier layer of the plasma display device includes coating a barrier material layer on a substrate, forming a photosensitive layer on the barrier material layer, exposing the photosensitive layer to light through a mask, the mask having a pattern corresponding to cells of the plasma display device, and etching the barrier material layer to form said plurality of cells.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention:

DETAILED DESCRIPTION OF PREFERRED EMBODIMENT

Reference will now be made in detail to the preferred embodiments of the present invention, examples of which are illustrated in the accompanying drawings.

Figure 1:
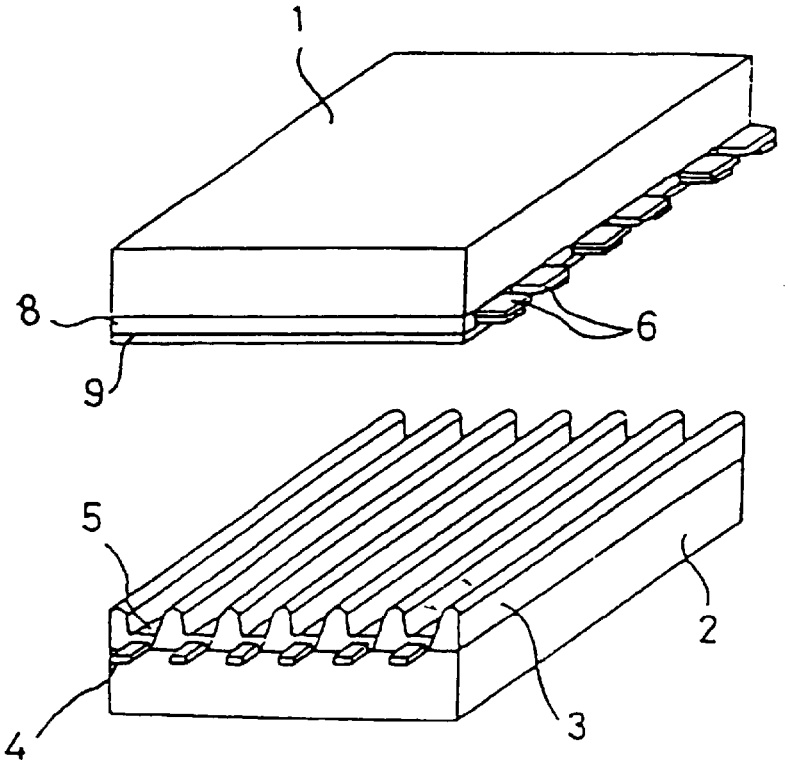
FIG. 1 PRIOR ART
FIG. 1 is a perspective view of the front and back substrates of a conventional PDP.
Figure 2:
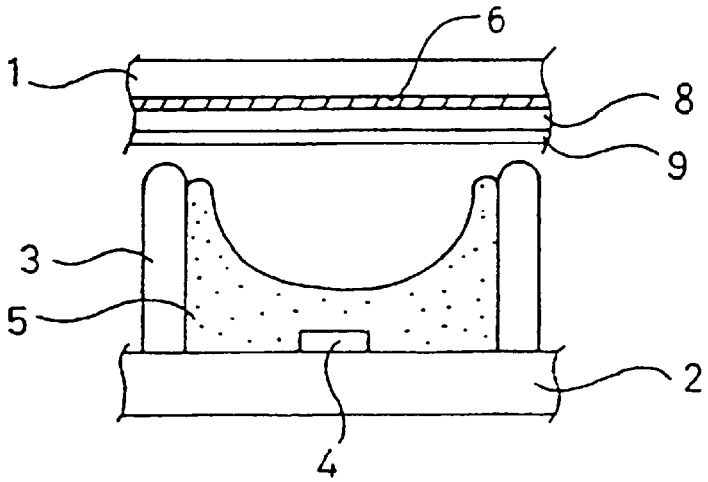
FIG. 2 PRIOR ART
FIG. 2 is a cross-sectional view of the conventional PDP.
Figure 3:
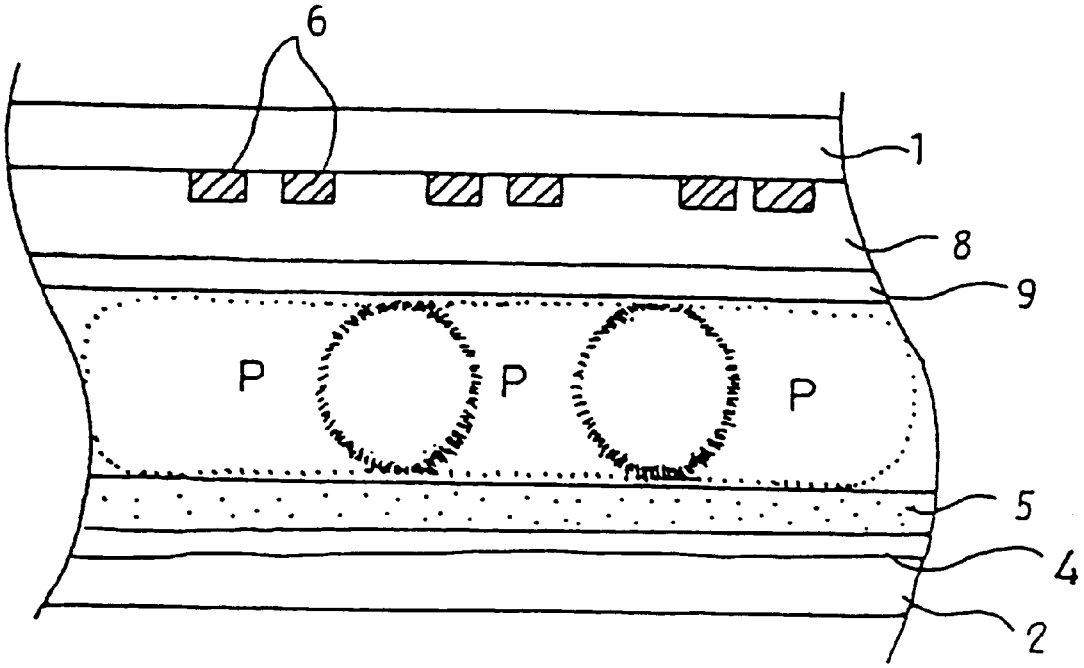
FIG. 3 PRIOR ART
FIG. 3 is a cross-sectional view of the discharge space of the conventional PDP.
Figure 4:
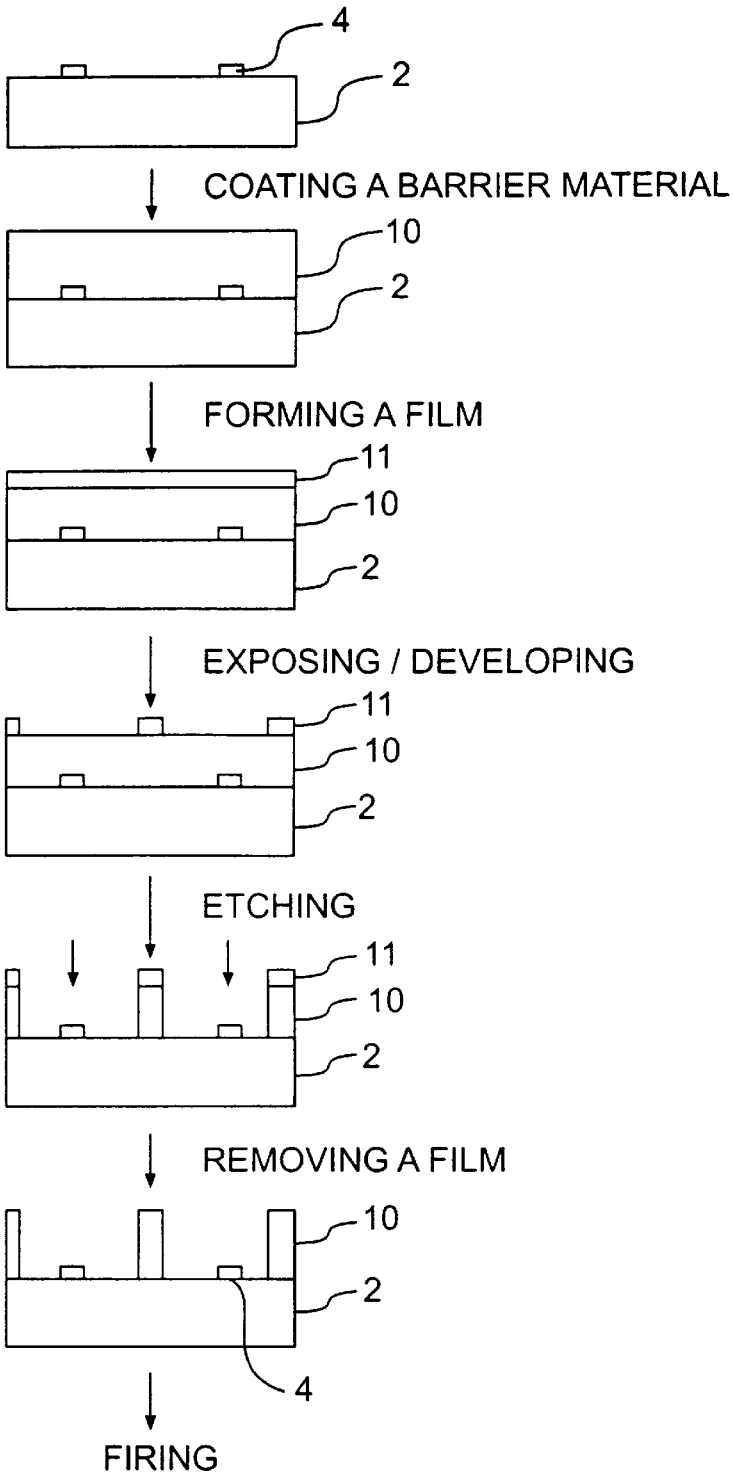
FIG. 4 PRIOR ART
FIG. 4 is a cross-sectional view showing a process of forming the barrier of the conventional PDP.
Figure 5:
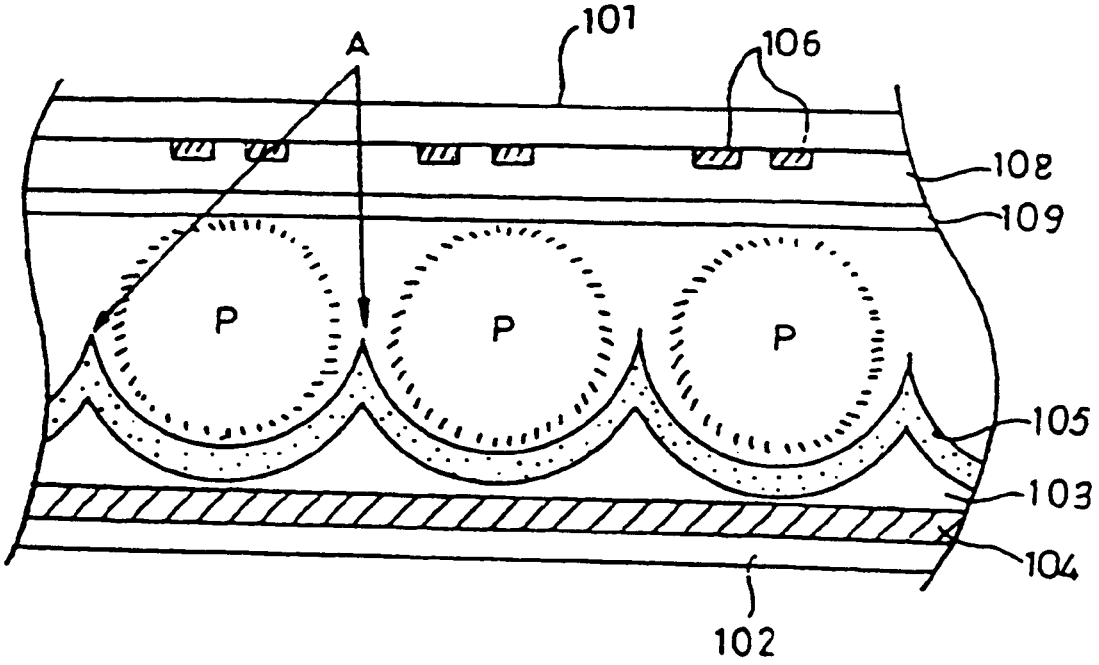
FIG. 5 is a cross-sectional view of the discharge space of a PDP according to the present invention.

The discharge space structure according to the present invention is described below with reference to FIG. 5. As shown in FIG. 5, a PDP of the present invention is constructed in such a manner that the front substrate 101 and back substrate 102 are combined, a dielectric layer 108 is formed on sustain electrodes 106 arranged on the front substrate 101, a protective layer 109 is formed on dielectric layer 108, address electrodes 104 are arranged on the back substrate 102, barriers 103 are formed between address electrodes 104, and a fluorescent layer 105 is formed on the inner walls of barriers 103. A discharge space P formed by fluorescent layer 105 which is formed between barriers 103 and has a hemispheric shape. The barriers 103 are formed such that they fail to contact the first substrate. Fluorescent layer 105 is formed with a certain height at boundary A between cells in the same stripe and its height is gradually reduced from boundary A to the center of each cell. Though fluorescent layer 105 is formed in a hemispherical shape in this embodiment, fluorescent layer 105 and sides of barrier 103 can have any shapes if discharge space P is formed in a shape similar to a plasma formation shape.

Figure 6A:
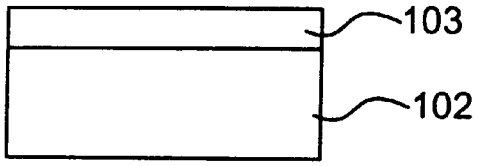
FIGS. 6A, 6B and 6C are cross-sectional views showing a process of forming the barrier of the PDP according to the present invention.
Figure 6B:
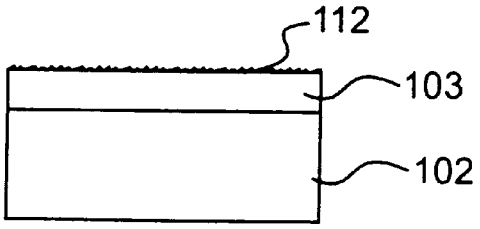
Figure 6C:
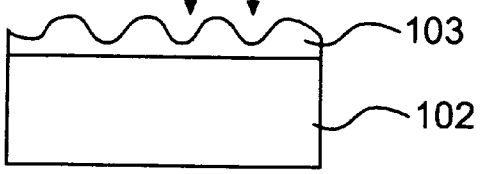
Figure 7:
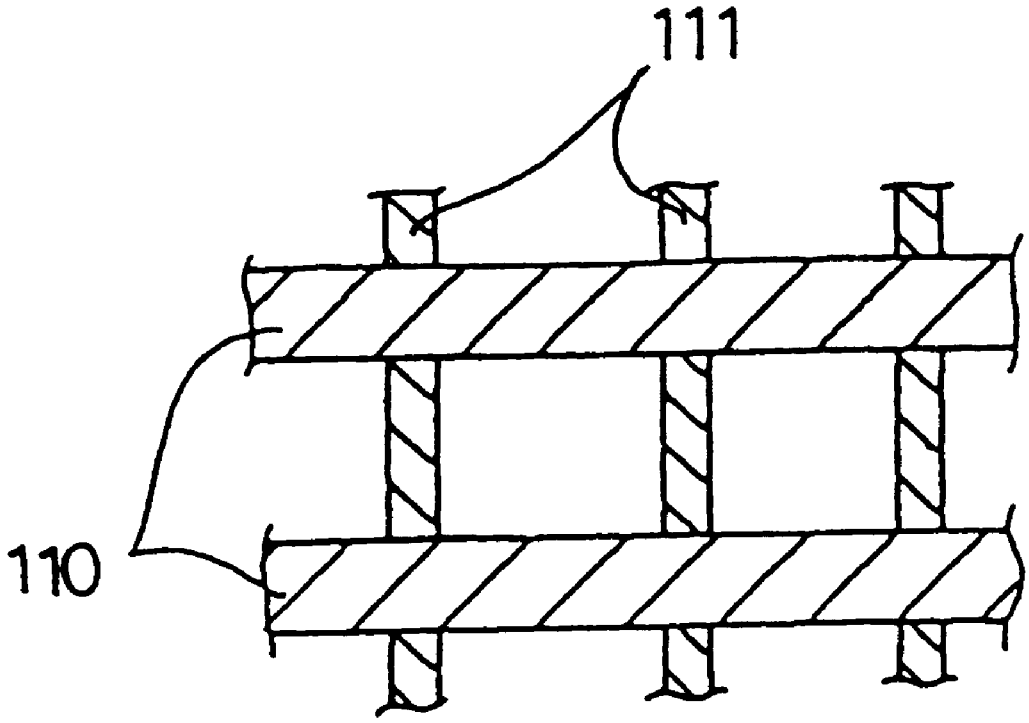
FIG. 7 is a view showing a mask employed for forming the barrier according to the present invention.

A method of forming the barrier to obtain the discharge space structure shown in FIG. 5 is explained below with reference to FIGS. 6A, 6B and 6C. Referring to FIG. 6A, a barrier material 103 is coated on back substrate 102 on which the electrodes are formed. Referring to FIG. 6B, photoresist 112 is coated on barrier material layer 103, and exposure is performed to the back substrate on which barrier material layer 103 is coated using a mask shown in FIG. 7. Referring to FIG. 6C, the barrier material layer is developed and etched, to form barrier 103. The mask used for the exposure process has a horizontal pattern 110 for exposing the barrier, and a vertical pattern 111 for forming boundary region A between neighboring cells in the same stripe, which is perpendicular to the horizontal patterns.

The operation of the PDP according to the present invention is explained below. When voltage of above 100V is applied between electrodes of the front and back substrates to drive the display panel, ultraviolet ray discharge is generated between a couple of sustain electrode 106 and address electrode 104. When a visible ray is emitted from R,G,B fluorescent materials of fluorescent layer 105 while the plasma forming region P of the discharge space is as shown in FIG. 5, this visible ray is not diffused into neighboring cells in the same stripe but emitted to the front of the panel.

Figure 8A:
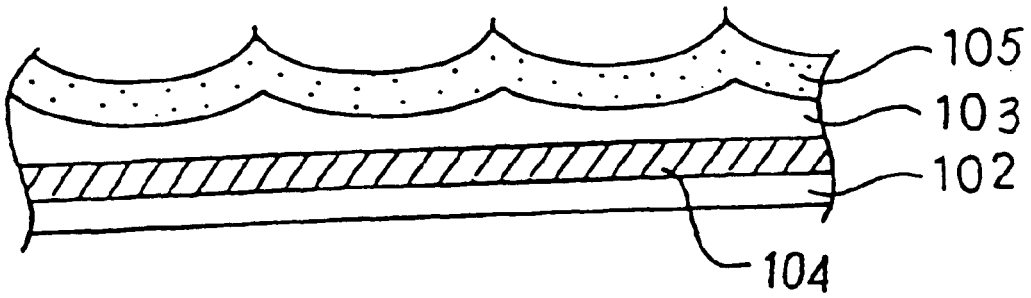
FIGS. 8A and 8B show discharge space structures according to another embodiment of the present invention.
Figure 8B:
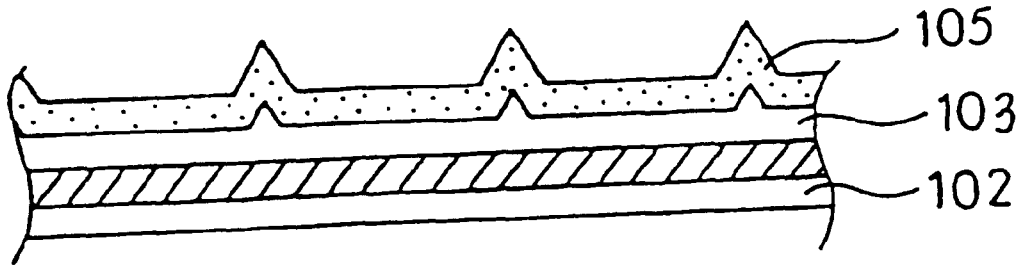

FIGS. 8A and 8B show discharge space structures according to another embodiment of the present invention. FIG. 8A shows that the portion of fluorescent layer 105 corresponding to each discharge space has a semi-elliptical shape and FIG. 8B shows that a certain area of the center of fluorescent layer 105 is flat. As described above, according to the present invention, color spread due to diffusion of visible ray between cells is prevented, resulting in improvement in luminance of the PDP.

It will be apparent to those skilled in the art that various modifications and variations can be made in the discharge space structure of a PDP and method of fabricating its barrier of the present invention without departing from the spirit or scope of the invention. Thus, it is intended that the present invention cover the modifications and variations of this invention provided they come within the scope of the appended claims and their equivalents.

What is claimed is:

1. A plasma display panel, comprising:

first and second substrates opposite each other;

a plurality of linear parallel barriers formed on one of said first and second substrates;

a plurality of raised portions extending substantially perpendicularly between adjacent barriers, said raised portions extending from one of said first and second substrates fail to contact the other substrate; and a plurality of discharge spaces, each space being formed between the first substrate and the second substrate and being defined by two adjacent barriers and two adjacent raised portions.

2. The plasma display panel as claimed in claim 1, wherein the plurality of barriers and raised portions comprise a barrier layer, and the barrier layer includes a flourescent layer.

3. The plasma display panel as claimed in claim 1, wherein the plurality of barriers and raised portions are shaped to prevent discharge between adjacent discharge spaces.

4. The plasma display panel as claimed in claim 2, wherein a portion of the flourescent layer is flat.

5. The plasma display panel as claimed in claim 2, wherein a portion of the flourescent layer corresponding to each discharge space has a hemispherical shape.

6. The plasma display panel as claimed in claim 2, wherein a portion of the flourescent layer corresponding to each discharge space has a semi-elliptical shape.

7. The plasma display panel as claimed in claim 2, wherein a discharge space defined by the flourescent layer has a plasma formation shape.

8. The plasma display panel as claimed in claim 1, wherein the discharge spaces are each formed in a plasma formation shape.

9. The plasma display panel as claimed in claim 1, wherein the plurality of barriers and raised portions comprise a barrier layer, and a height of the barrier layer decreases from a boundary between two discharge spaces to the centers of said spaces.

10. The plasma display panel as claimed in claim 1, wherein the discharge spaces are spherical.

11. The plasma display panel as claimed in claim 7, wherein the plasma formation shape is spherical.

12. A plasma display panel, comprising:

a pair of substrates placed opposite each other;

a plurality of parallel linear barriers formed on one substrate of said pair of substrates;

a plurality of discharge spaces formed between the parallel linear barriers, each discharge space being formed between a pair of adjacent barriers and between a pair of raised portions extending perpendicularly between the pair of adjacent barriers; and said raised portions extending from one substrate of said pair of substrates fail to contact the other substrate.

13. The plasma display panel as claimed in claim 12, further comprising:

a flourescent layer formed on each barrier, and having a plurality of flourescent layer raised portions corresponding to the raised portions, each flourescent layer raised portion defining a boundary between adjacent discharge spaces between the barriers.

14. A method of making a barrier layer of a plasma display device, comprising:

coating a barrier material layer on a substrate;

forming a photosensitive layer on the barrier material layer;

exposing the photosensitive layer to light through a mask, said mask comprising a pattern of horizontal lines and vertical lines, wherein the horizontal lines define a plurality of parallel linear barriers, and wherein the vertical lines define a plurality of raised portions extending substantially perpendicularly between adjacent barriers and formed lower than said barriers; and etching perpendicularly between the barrier material layer to form said plurality of cells.

* * * * *